US007562757B2

(12) United States Patent
Dubach et al.

(10) Patent No.: US 7,562,757 B2
(45) Date of Patent: Jul. 21, 2009

(54) ACTUATING DEVICE WITH AT LEAST ONE ACTUATING ARM

(75) Inventors: Fredi Dubach, Baeretwil (CH); Christian Omann, Hard (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 11/819,100

(22) Filed: Jun. 25, 2007

(65) Prior Publication Data

US 2008/0121490 A1 May 29, 2008

Related U.S. Application Data

(63) Continuation of application No. PCT/AT2005/000522, filed on Dec. 22, 2005.

(30) Foreign Application Priority Data

Dec. 28, 2004 (AT) ..... A 2182/2004

(51) Int. Cl.
*E05F 3/00* (2006.01)
*E05F 1/10* (2006.01)
*E05D 15/26* (2006.01)

(52) U.S. Cl. ..... 192/215; 16/82; 16/319; 188/82.77; 188/184; 312/319.2

(58) Field of Classification Search ..... 192/216, 192/105 BB; 49/322; 188/291
See application file for complete search history.

(56) References Cited

U.S. PATENT DOCUMENTS 2,223,218 A * 11/1940 Little ..... 49/322
4,015,696 A * 4/1977 Lichti ..... 188/189
4,618,039 A * 10/1986 Omata ..... 192/216
5,355,979 A * 10/1994 Stephan et al. ..... 192/216
5,494,093 A * 2/1996 Eiterman ..... 160/300
5,697,476 A * 12/1997 Susmark ..... 188/82.7

FOREIGN PATENT DOCUMENTS

| | | |
|---|---|---|
| DE | 77 05 285 | 6/1977 |
| DE | 78 34 224 | 2/1979 |
| DE | 28 43 588 | 4/1980 |
| EP | 0 298 514 | 1/1989 |
| EP | 1 055 381 | 11/2000 |
| EP | 1 563 155 | 8/2005 |
| GB | 2 252 790 | 8/1992 |
| GB | 1 576 292 | 11/2000 |
| WO | 03/97973 | 11/2003 |
| WO | 2004/044360 | 5/2004 |

* cited by examiner

*Primary Examiner*—Rodney H Bonck
(74) *Attorney, Agent, or Firm*—Wenderoth, Lind & Ponack, L.L.P.

(57) ABSTRACT

The invention relates to an actuating device for moving a flap of a piece of furniture, including at least one actuating arm for moving the flap, a base member on which the actuating arm is pivotally arranged, and a spring device able to act upon the actuating arm. An assembly securing device for the vacant actuating arm, which has not yet been fitted with a flap, includes a braking device which limits the opening speed of the vacant actuating arm.

13 Claims, 12 Drawing Sheets

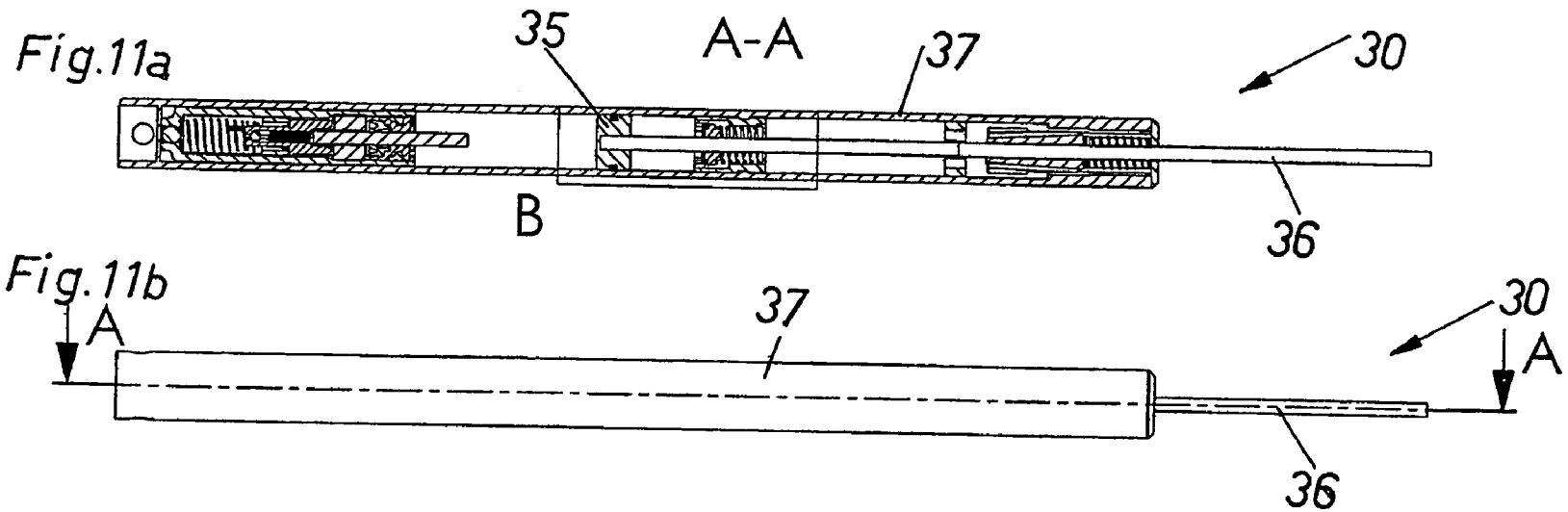
Fig.11a
Fig.11b
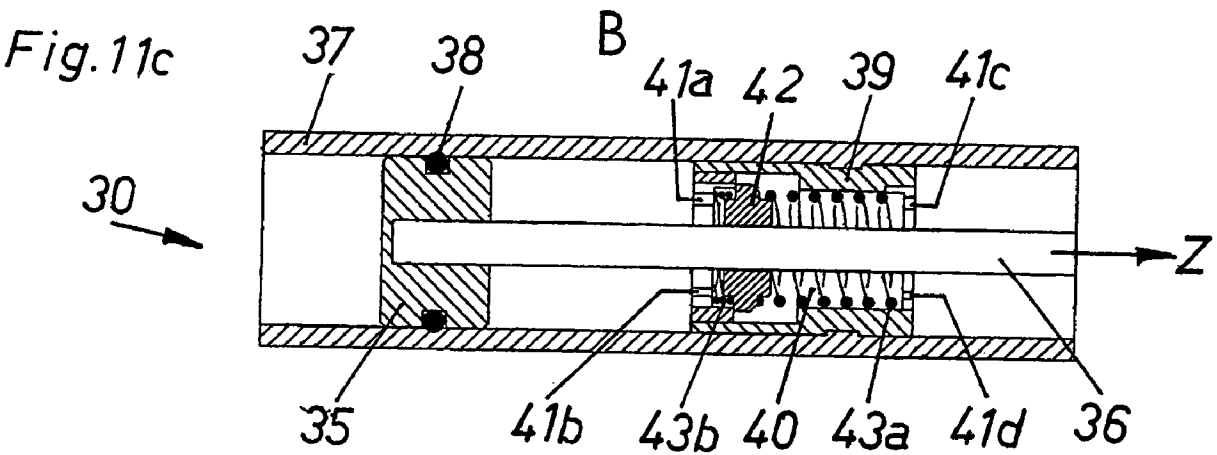
Fig.11c

C-C
30
36
37
35
D

30
C
36
37
C

Z
36
41c
41d
39
43a
40
42
43b
41a
41b
D
38
37
35

30

ACTUATING DEVICE WITH AT LEAST ONE ACTUATING ARM

This application is a continuation of International application No. PCT/AT2005/000522, filed Dec. 22, 2005.

BACKGROUND OF THE INVENTION

The present invention relates to an actuating device with at least one actuating arm, designed in particular to operate a flap of a piece of furniture, having a base member on which the actuating arm is pivotally located and a spring device to act upon the actuating arm.

Actuating devices of this type are generally attached onto a lateral wall of a piece of furniture and serve to move the flap connected to the actuating arm from the open to the closed position or vice-versa. According to the size and weight of the furniture flap, the actuating devices are provided with a spring device which moves the actuating arm with extremely high prestress forces so that even heavy flaps on items of furniture can be moved. Critical torques arise during the transporting, fitting or changing of the flap since the charging spring device accelerates the relatively light actuating arm like a bullet from a gun. For this reason there are instructions on the casing of such actuating devices which refer to the danger of the kicking actuating arm. The actuating arm directed by the spring device can cause serious injury at the critical torques referred to above when no flap is connected to the actuating arm.

It is therefore an object of the present invention to improve the actuating device of the type referred to in the introduction by reducing the danger alluded to above or by facilitating the manipulation of the actuating device when being assembled or fitted with a flap.

SUMMARY OF THE INVENTION

In a preferred embodiment of the present invention, the above object is achieved by an assembly securing device for the vacant actuating arm which has not yet been fitted with a flap. The assembly securing device comprises a braking device which limits the opening speed of the vacant actuating arm.

A preferred embodiment of the invention provides that the braking device which interacts with the actuating arm is designed such that its operation depends in such a way on the swing speed of the actuating arm such that the actuating arm is essentially freely movable below a predetermined swing speed and such that the braking device brakes the actuating arm at a swing speed being greater than or equal to the predetermined swing speed.

Within the context of this invention, "spring device" is understood to include not only spring devices with mechanical spring components, but also all power storage units in accordance with the state of art, such as, for example, gas pressure storage units or the like.

The braking device provided can effectively prevent the actuating arm from unintentionally opening or kicking out. The braking device permits a slow, controlled movement of the actuating arm similar to the operating principle of safety belts in vehicles. Any sudden movement of the actuating arm—effected by the spring device—at the same time that the swing speed exceeds a threshold value will effect a deceleration or also a sudden stopping of the actuating arm.

A preferred embodiment of the invention provides that the braking device comprises a snap-in locking device.

The actuating arm is generally movable between an external end position that corresponds to an opened flap and an internal end position. Thereby the base member can be secured on or in an item of furniture, so as to allow a flap to move by at least one actuating arm between a completely open position and a completely closed position.

One preferred embodiment of the invention provides for the braking or stopping device to be activated by exceeding a predetermined or presettable swing speed of the actuating arm. If the swing speed of the actuating arm or the torque applied thereon does not exceed a certain value, the braking or stopping device will remain inactive. This means that the braking or stopping device does not affect the movement of the flap during normal use.

By means of the braking or locking device, the swing speed of the actuating arm can be reduced and/or the actuating arm can be arrested temporarily in its pivoting position. The swing speed of the actuating arm can thereby be gradually reduced or abruptly decelerated to zero.

One preferred embodiment of the invention provides for the braking or stopping device to comprise a mechanical clutch device. In this connection, it can be advantageous if the mechanical clutch device comprises a centrifugal clutch. Thereby a first—preferably spring-loaded—clutch member can be formed or arranged onto the actuating arm, wherein this first clutch member is arranged on the bearing axis of the actuating arm with a freedom of radial movement on the bearing axis of the actuating arm and which forms part of the centrifugal clutch. If the swing speed of the actuating arm exceeds the threshold value, then the first clutch member is pressed radially outwards due to the operative centrifugal force. In this context, it is advantageous if the first clutch member comprises at least one stopping tooth which can be applied in one position to a second clutch member, preferably an internally geared ring. As an alternative to this latching and in compliance with another embodiment of the invention, the first clutch member can be fitted with at least one friction lining which can engage in one position with a second clutch member that is also preferably fitted with a friction lining. The centrifugal force which occurs then results in the friction linings being subjected to a counter pressure, enabling the actuating arm swing speed to be reduced.

In connection with the centrifugal clutch, the first clutch member can be urged by at least one energy storing device, preferably a spring, so that the first clutch member can be disengaged from the second clutch member. By means of the energy storing device, the first clutch member can be moved back into a ready position. On the other hand, the dimensioning of the energy storing device determines the threshold value of the actuating arm swing speed since the centrifugal clutch can be activated after surpassing the same. In this connection, it can be an advantage if the swing speed threshold value can be determined or set by the energy storing device. If the energy storing device is formed by at least one spring, then the swing speed threshold value can be set by the prestressing of the spring.

In one preferred application of the invention, the energy storing device can be arranged so as to operate between the first clutch member and a receiving member which is in preference arranged co-axially to the bearing axis of the actuating arm.

If the receiving member is connected to the actuating arm bearing axis in a torque proof manner, then the system will stop abruptly if the swing speed is exceeded. In accordance with this embodiment, the receiving member can be fitted to the bearing axis in a rotatable manner. This can be useful when the rotary motion of the receiving member is attenuated by a damping device. It is particularly advantageous if the damping device has at least one friction damper and/or at least one fluid damper, preferably a rotary damper or a linear damper. If the receiving member is so dampened, the system will not stop suddenly but will be decelerated gently, so enabling the operating forces and torques to be reduced.

In compliance with a further beneficial embodiment, the braking device can comprise at least one fluid damper, preferably a linear damper. The design can be such that the fluid damper engages directly or indirectly with the actuating arm. Of course, a rotary damper with a corresponding structure in compliance with the design can also be used.

An advantageous embodiment of the invention provides that the actuating device comprises a spring device with a spring-loaded setting part and a transmission mechanism which transforms the motion of the setting part into a pivoting movement of the actuating arm. The transmission mechanism comprises at least one intermediate lever which is on the one hand directed by the spring-load setting part and which abuts on the other hand—preferably via a thrust roll—onto a control cam which is arranged or formed on the actuating arm. The braking device comprises at least one fluid damper which hingedly acts upon the control cam of the actuating arm .

According to a further embodiment of the invention, the fluid damper of the braking device can act upon the transmission mechanism, preferably onto the intermediate lever.

BRIEF DESCRIPTION OF THE DRAWINGS

Further details and advantages of the present invention are explained in more detail by the description of figures hereinafter, in which FIGS. 11*a*-11*c* are various views of a fluid damper as part of the inventive braking device, wherein the fluid damper permits free movement of the piston rod and of the actuating arm, respectively.

DETAILED DESCRIPTION OF THE INVENTION

Figure 1A:
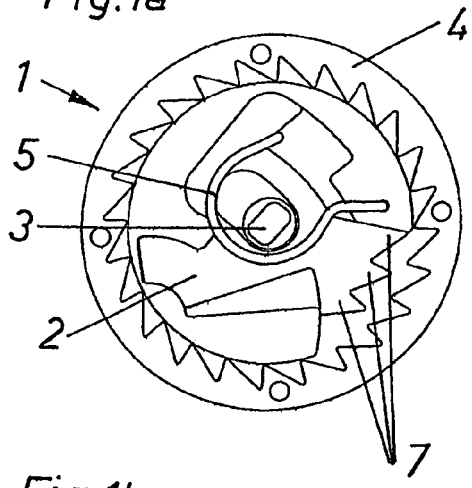
FIGS. 1*a*-1*e* are various views of an example of a braking or stopping device.
Figure 1D:
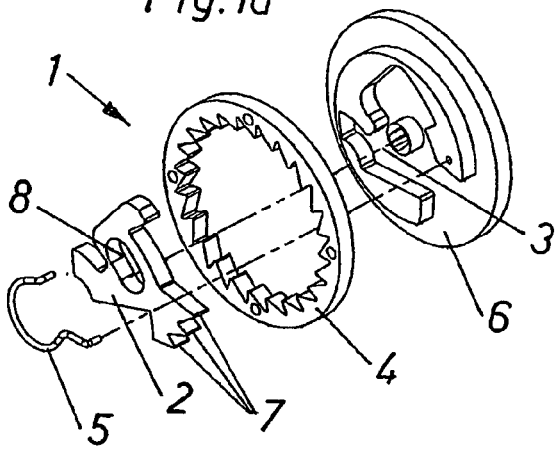
Figure 1B:
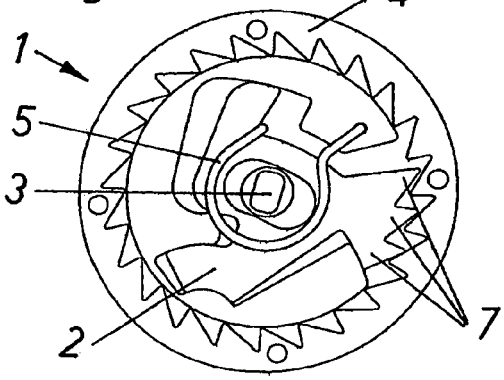
Figure 1E:
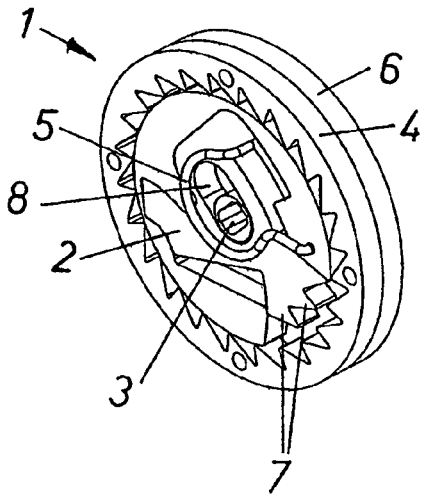
Figure 1C:
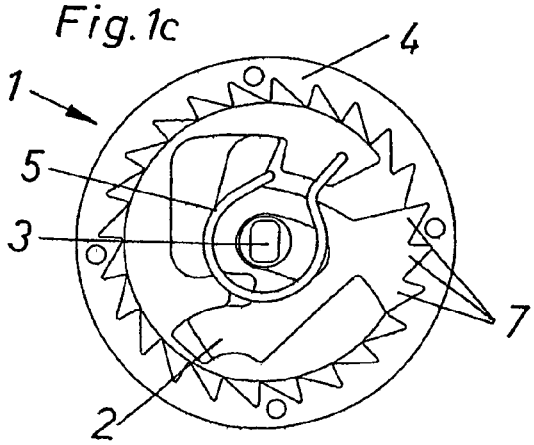

FIGS. 1*a*-1*e* show various views of an example of a braking or stopping device 1 according to the invention. FIG. 1*a*-1*c* show various temporal sequences of the engaging process if a threshold value of the swing speed of an actuating arm—which is not shown for reasons of clarity—is exceeded. FIG. 1*a* shows the braking or stopping device 1 in the non-geared state, FIG. 1*b* shows the moment of the snap-in procedure and FIG. 1*c* shows the at rest status. As can be seen in particular from the representation of the explosion in FIG. 1*d*, the braking or stopping device 1 is designed as a ratched locking mechanism with a ratchet gear. A receiving member 6 is fitted coaxially to the bearing axis 3 of the actuating arm. The receiving member 6 is constructed so that the second clutch member 4 can be pushed onto the latter. In the example shown, the second clutch member 4 is constructed as an internally toothed ring. The first clutch member 2 forms the counter-piece to the internally toothed ring 4. The first clutch member 2 is constructed so that it is located on the bearing axis 3 with a freedom of radial movement, which is made possible by slotted (elongated) hole 8. In addition, the first clutch member 2 has at least one ratchet or at least one stop tooth 7 which can engage the graduated internal gearing of ring 4. A spring 5, the dimensions of which determine the threshold value of the swing speed, operates between the first clutch member 2 and receiving member 6. The first clutch member 2 is either located on or designed as part of the actuating arm or is preferably coaxially coupled to it. If the actuating arm is now urged (moved) by a spring device which is not shown, this centrifugal clutch can become active. If the force of spring 5 is surpassed, the first clutch member 2 is pressed outwards due to the centrifugal force which is operating, and stop teeth 7 can engage with the graduated gearing of ring 4. FIGS. 1*a*-1*c* show the engaging process. FIG. 1*e* shows a perspective representation of braking or stopping device 1. The same mechanism can be used not only for the gearing of both clutch members 2 and 4, but it is also within the scope of the invention to fit, instead of stopping teeth 7, a friction lining to the first clutch member 2, which can work together with a friction lining of the second clutch member due to the centrifugal force which is operating.

Figure 2A:
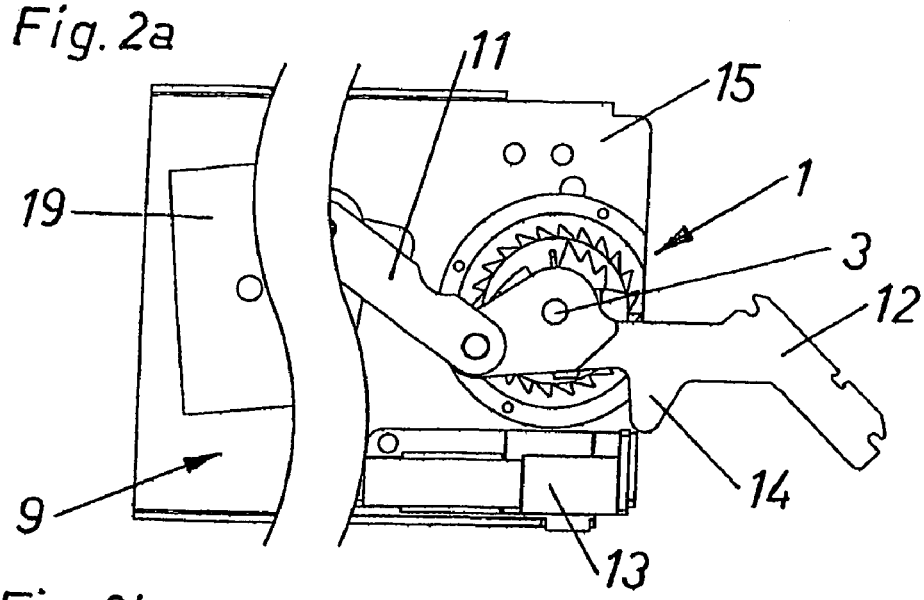
FIGS. 2*a*-2*c* illustrate temporal sequences of a graduated gearing of the braking or stopping device which forms part of the actuating device according to the invention.
Figure 2B:
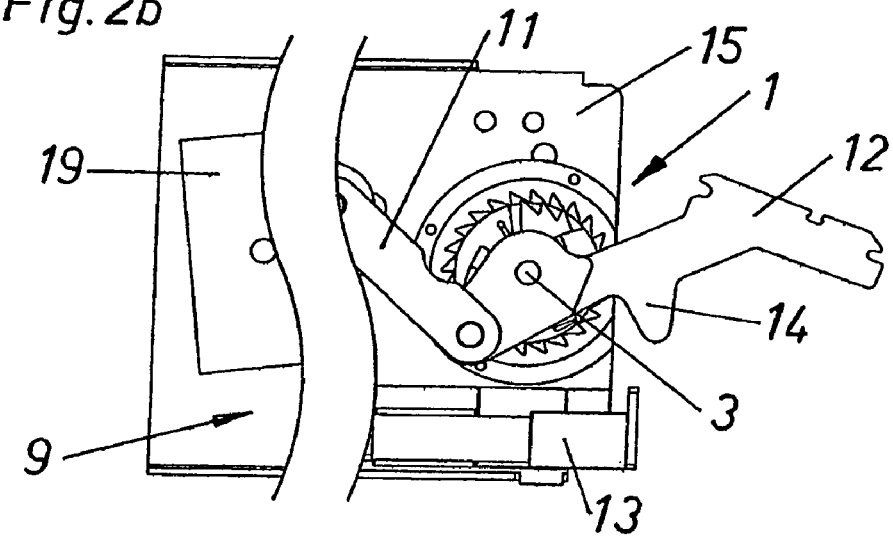
Figure 2C:
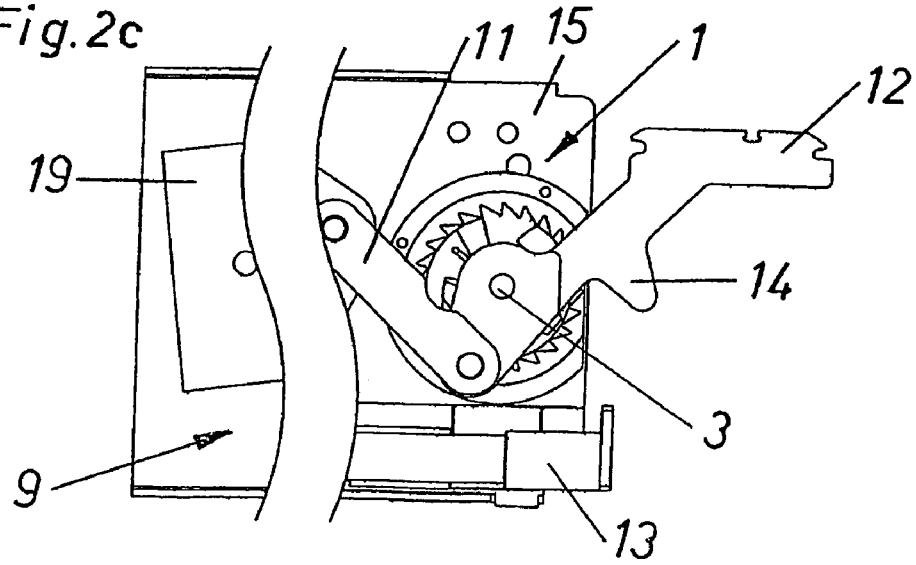

FIGS. 2*a*-2*c* show temporal sequences of engaging process of the braking or stopping device 1 in connection with an actuating device 9 which is provided to move a furniture flap from the closed to the open position or in the opposite direction. Base member 15 of the actuating device 9 is generally secured to a lateral wall of an item of furniture. Actuating arm 12 is located on bearing axis 3. A spring device 19 which acts upon the actuating arm 12 with a torque via an intermediate lever 11 is provided in order to balance the weight of the furniture flap. Critical torques may arise if the furniture flap is not yet attached, and this may allow actuating arm 12 to open unintentionally and cause accidents to the operating staff. For this reason, the braking or stopping device 1 is preferably fitted coaxially to the bearing axis 3 of the actuating arm 12. FIG. 2*a* shows the braking or stopping device 1 in the non-geared state in which the actuating arm 12 can move freely, i.e. it permits a pivoting movement. If the swing speed of the actuating arm 12 exceeds a prescribed or prescriptive threshold value, clutch members 2 and 4 as described in FIGS. 1*a*-1*e* will gradually begin to connect with each other as shown in FIG. 2*b*. FIG. 2*c* shows the geared position of braking or stopping device 1 in which both clutch members 2 and 4 have completely engaged with each other. A damper 13 which can be activated on closing the flap by a lug 14 on the actuating arm 12 is provided in order to prevent or at least to reduce banging noises when the furniture flap closes.

Figure 3:
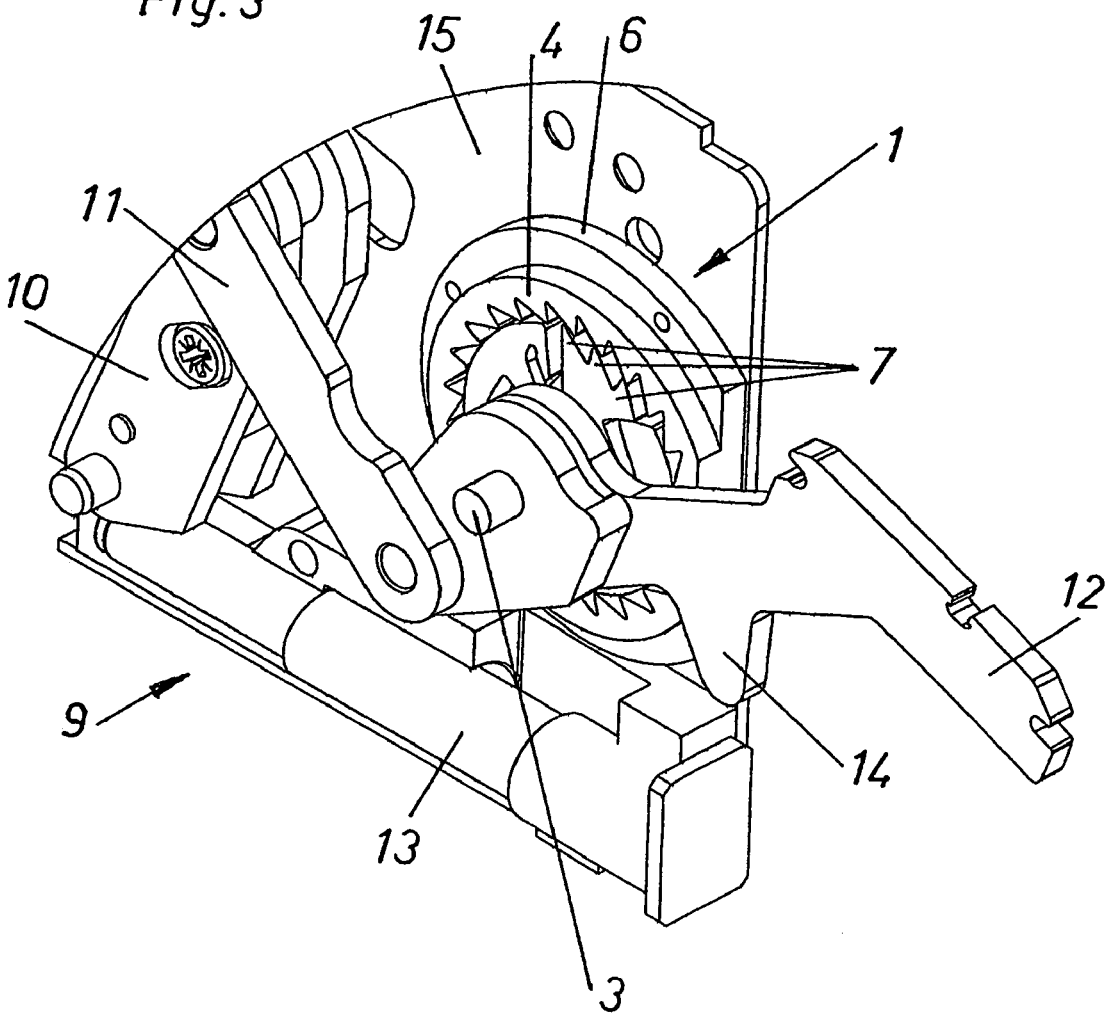
FIG. 3 is a perspective view of the braking or stopping device.

FIG. 3 shows a perspective view of the actuating device 9 in compliance with the invention. A pivotal lever 10 which is urged by a spring device 19 is connected to an intermediate lever 11 which is in turn coupled to the actuating arm 12. The actuating arm 12 serves to move a furniture flap and is located on bearing axis 3 of base member 15. In order to limit the swing speed of the actuating arm 12, a braking or stopping device 1 is provided, which in the shown embodiment is also positioned coaxially with respect to bearing axis 3. Stopping teeth 7 of first clutch member 2 can engage with the gearing of ring 4 when the prescribed swing speed or the operating torque is exceeded; this will stop the motion of coupled actuating arm 12. In the example shown, receiving member 6 is fitted to bearing axis 3 in a torque proof manner. As shown in FIG. 3, the ring 4 and receiving member 6 are formed as one integral piece or are fastened together so as to essentially function as one integral piece. Thus, when first clutch member 2 engages ring 4, it also effectively engages and stops relative to receiving member 6, to thereby immediately stop actuating arm 12 (to which first clutch member 2 is connected).

Figure 4:
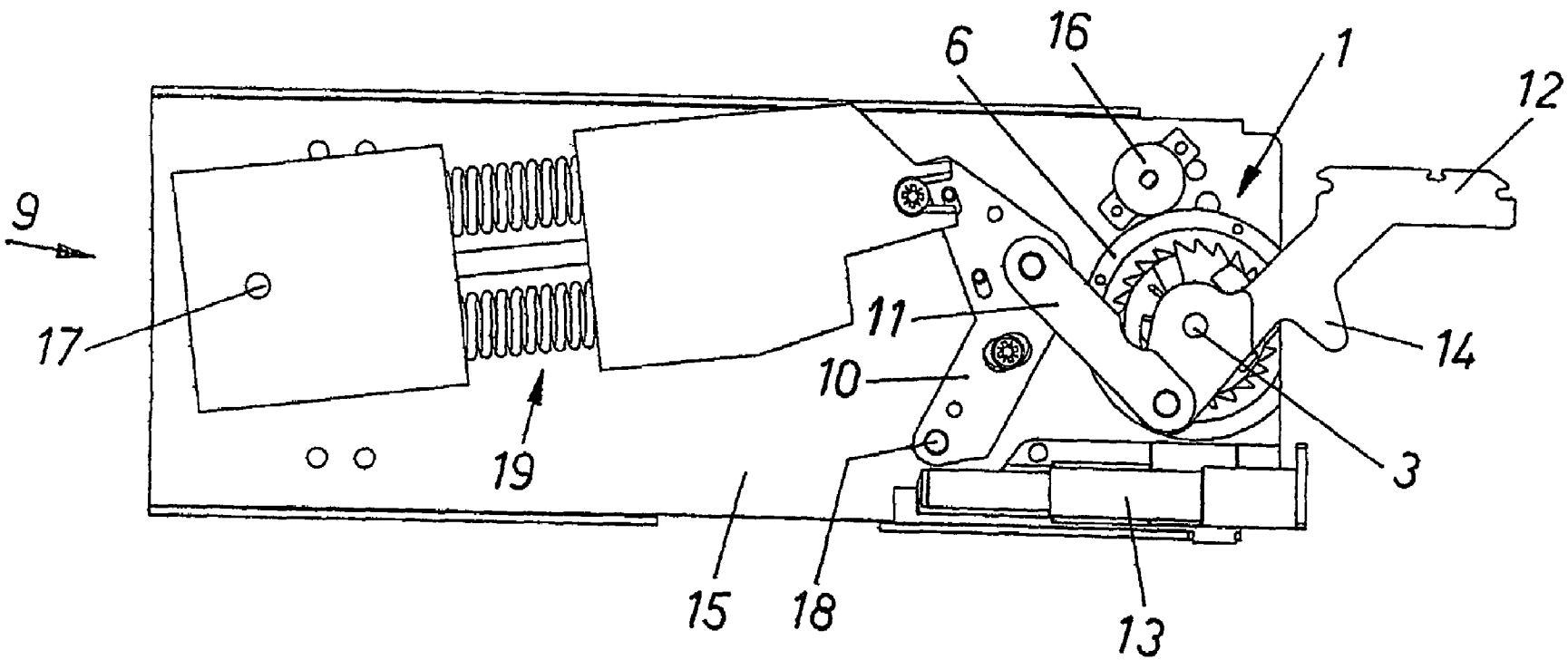
FIG. 4 shows a further embodiment of the invention with a dampened receiving member.

FIG. 4 shows an alternative embodiment of the invention. The actuating device 9 has a base member 15 on which a spring device 19 is located at swing point 17. This spring device 19 directs a pivotal lever 10 which is located on pivotal point 18. The force on actuating arm 12 is transferred by an intermediate lever 11 which is articulated on pivotal lever 10 on the one side and on actuating arm 12 on the other. In contrast to the embodiment shown in FIGS. 1-3, the receiving member 6 is not arranged on bearing axis 3 as being rigidly connected thereto, but it permits a rotary movement. This rotary motion is dampened by a damper device 16 which works together with receiving member 6. In the example shown, damper device 16 is designed as a rotary damper which is connected to the outside of receiving member 6. The advantage of this is that the system does not stop abruptly when braking or stopping device 1 is applied, but is gently and steadily decelerated.

Figure 5:
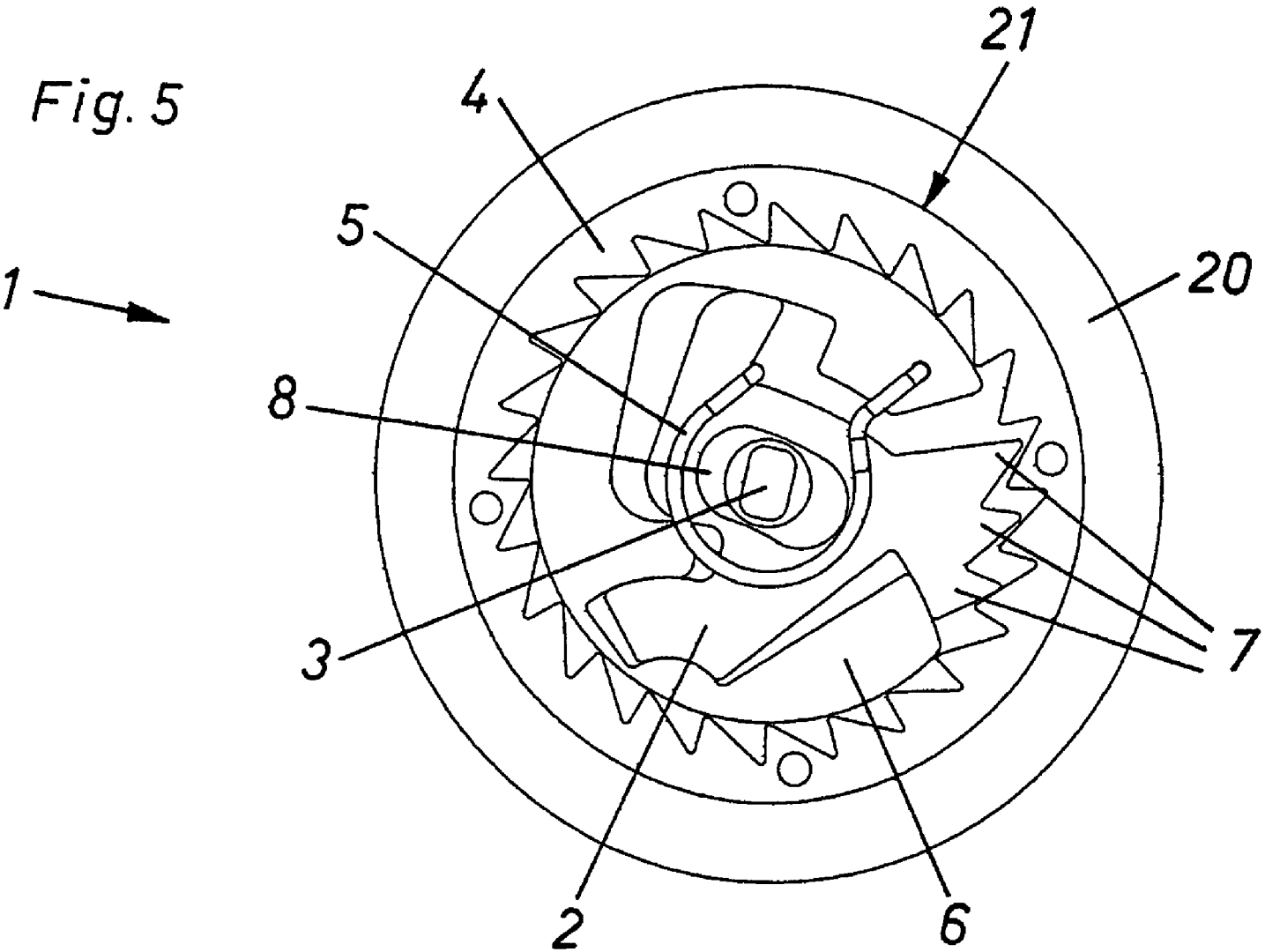
FIG. 5 shows a further embodiment with a stopping and a braking device.

FIG. 5 shows another embodiment of the present invention. The operating principle of braking or stopping device 1 is similar to that in FIG. 4, in which there is no sudden stop of actuating arm 12 which is not shown when stopping teeth 7 engage with internally toothed ring 4. Instead of rotary damper 16 shown in FIG. 4, the outside of internally toothed ring 4 engages with a friction lining 21 of an external friction ring 20, where friction ring 20 is preferably arranged in a fixed position. Friction lining 21 is designed so that it is twistable in a sluggish manner relative to friction ring 20, so that a relative motion of both parts 4, 20 is possible. Friction lining 21 can consist of at least one rubber layer (e.g. with multi-discs) or else of a high viscosity fluid. If the prescribed threshold value of the swing speed is exceeded, the first step will be that stopping teeth 7 will engage with internally toothed ring 4. The anti-clockwise pivotal motion of internally toothed ring 4 generated by the energy supplied will be decelerated by friction lining 21. In addition to the engagement, this leads to a braking effect when the prescribed swing or angular speed of actuating arm 12 is exceeded, which consequently results in a dampened pivotal motion of actuating arm 12 until this latter stops.

Figure 6:
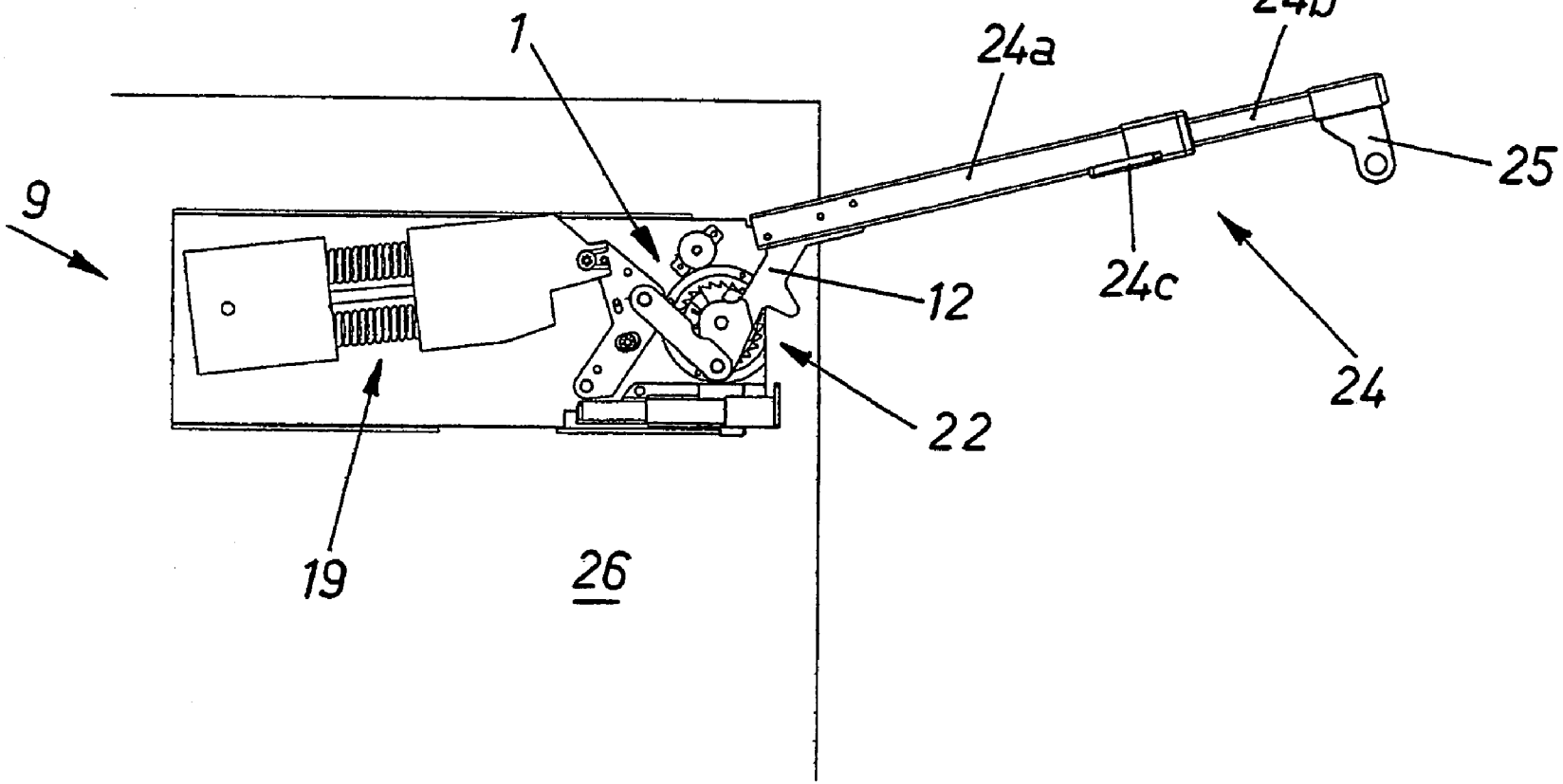
FIG. 6 shows the actuating device secured to a lateral wall of the furniture to which no flap has yet been fitted.

FIG. 6 shows an actuating device 9 in compliance with the invention which is secured to a lateral wall 26 of the furniture. Actuating device 9 corresponds to the construction as already described in FIG. 4, in which the actuating arm 12 is directed by spring device 19 and there is the consequent inherent danger that a flap which is not yet articulated will deflect abruptly. To this end, an assembly securing device 22 is provided for the vacant actuating arm to which no flap has as yet been fitted. Assembly securing device 22 comprises a braking device 1 which restricts the opening speed of actuating arm 12. In the figure shown, a actuating arm extension 24, consisting of parts 24*a* and 24*b* which can be telescoped relative to each other, is fitted to actuating arm 12. The relative position to each other of both parts 24*a* and 24*b* can be locked by clamping lever 24*c*. Actuating arm extension 24 can be secured to a flap on its free end by supporting section 25. Actuating arm 12 with its actuating arm extension 24 can essentially be moved freely below a prescribed swing speed, a braking and/or stopping of actuating arm 12 and its actuating arm extension 24 will occur at a swing speed being greater or equal than the prescribed swing speed.

Figure 7:
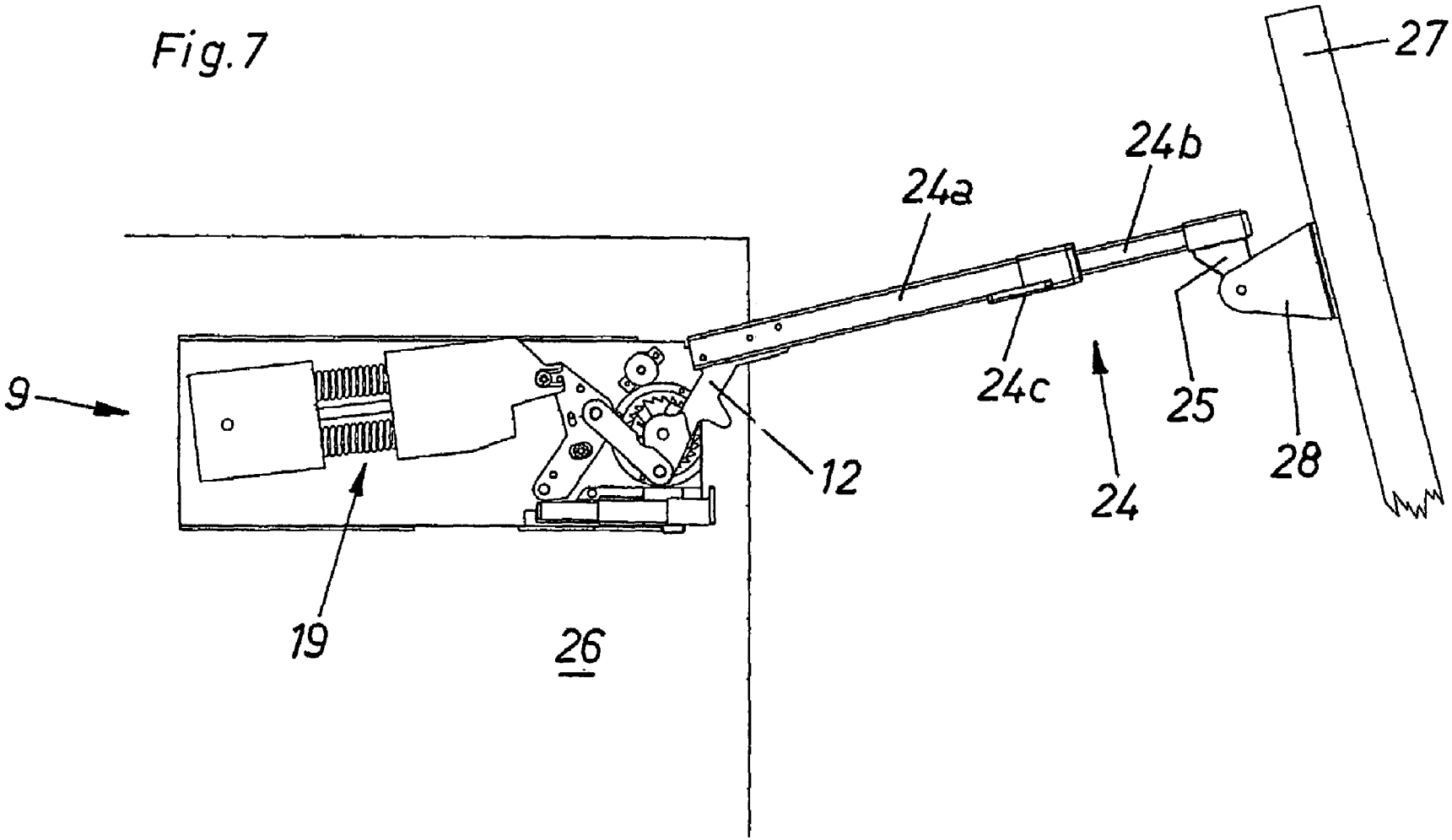
FIG. 7 shows the actuating device secured to the lateral wall with a flap fitted.

FIG. 7 shows an actuating device 9 in which supporting section 25 of actuating arm extension 24 is connected to a flap 27 by a fitting 28 on the side of the flap 27.

Figure 8:
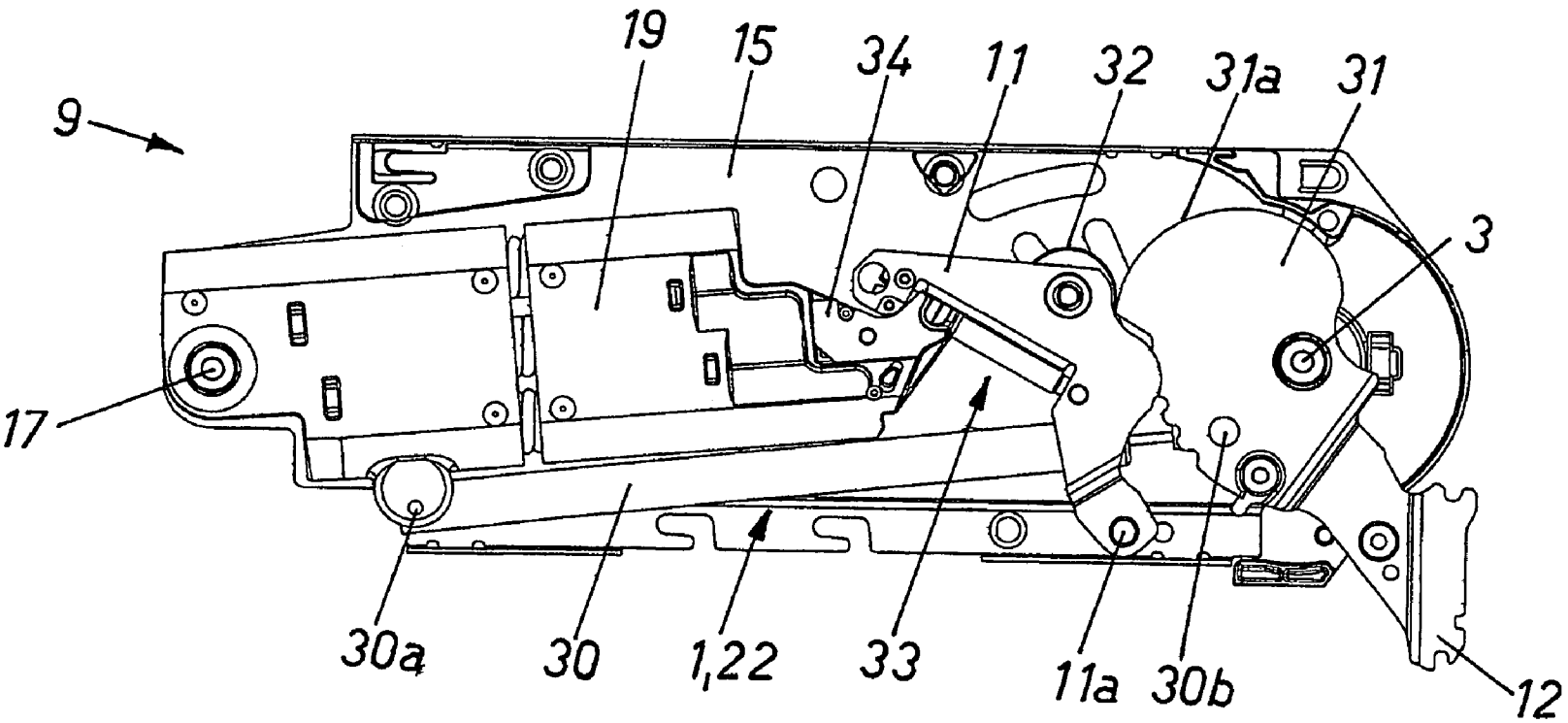
FIG. 8 shows a further embodiment of an actuating device with the actuating arm in the closed position and in which the braking device comprises a fluid damper.

FIG. 8 shows another embodiment of an actuating device 9 with a fluid damper 30 as part of braking device 1 in compliance with the invention. Actuating device 9 has a base member 15 on which a spring device 19 is located on pivotal point 17. A spring loaded setting part 34 is adjustably located on a transmission mechanism 33, in this case on an intermediate lever 11, so that the transmission ratio between the movement of spring loaded setting part 34 and the pivoting movement of actuating arm 12 can be altered. Intermediate lever 11 is pivotally located on pivotal axis 11*a* and rests with a thrust roll 32 onto a setting contour 31*a* of a control cam 31 so that thrust roll 32 runs along the setting contour during the pivoting movement of the actuating arm 12 or of actuating arm extension 24, which is not shown. Control cam 31 is pivotally arranged on bearing axis 3 and forms part of actuating arm 12. The force can be set onto control cam 31 by the adjustable position of spring device 19 on intermediate lever 11 so that, corresponding to its weight, a flap 27, which is not shown, is held in any desired position. A braking device 1 or an assembly securing device 22 comprising a fluid damper 30 in compliance with the invention is provided with a flap which is not articulated in order to prevent actuating arm 12 or actuating arm extension 24 from deflecting uncontrollably. Fluid damper 30 is on one side located and articulated to pivotal axis 30*a* and on the other to pivotal axis 30*b* of control cam 31 of actuating arm 12. Actuating arm 12 or actuating arm extension 24 is essentially freely movable below a prescribed swing speed. In this way, a swing speed being greater or equal than the prescribed swing speed will cause blocking of the fluid damper 30 and prevent any movement of actuating arm 12 which is too sudden and uncontrolled.

Figure 9:
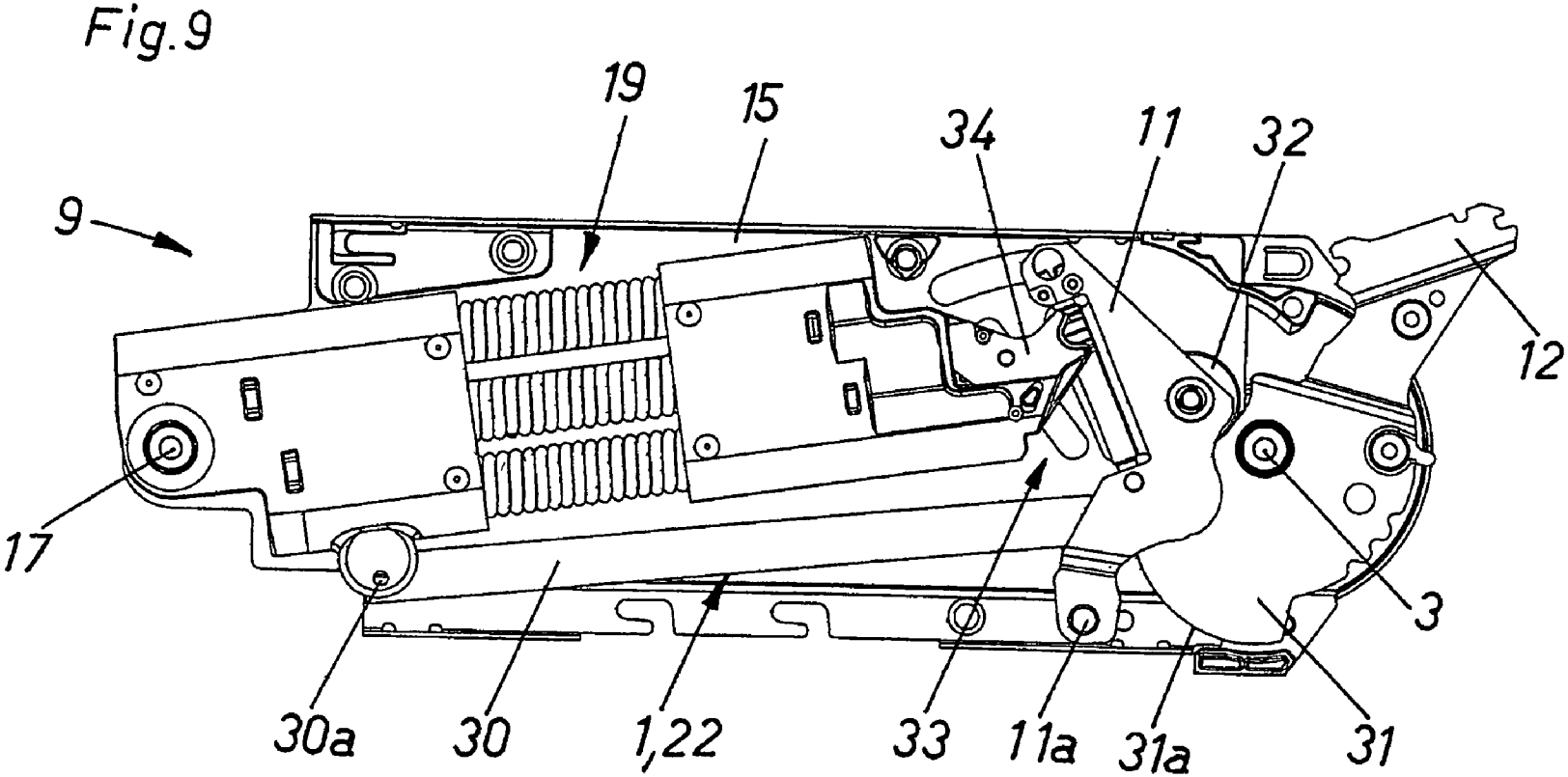
FIG. 9 shows the embodiment according to FIG. 8 with the actuating arm in an open position.

FIG. 9 shows the embodiment according to FIG. 8 with the fluid damper 30 as part of the braking device 1 by which the swing speed of actuating arm 12 can be reduced. In contrast to FIG. 8, actuating arm 12 is in an open position and the piston rod of fluid damper 30 is in a position which is further extended relative to the cylinder.

Figure 10:
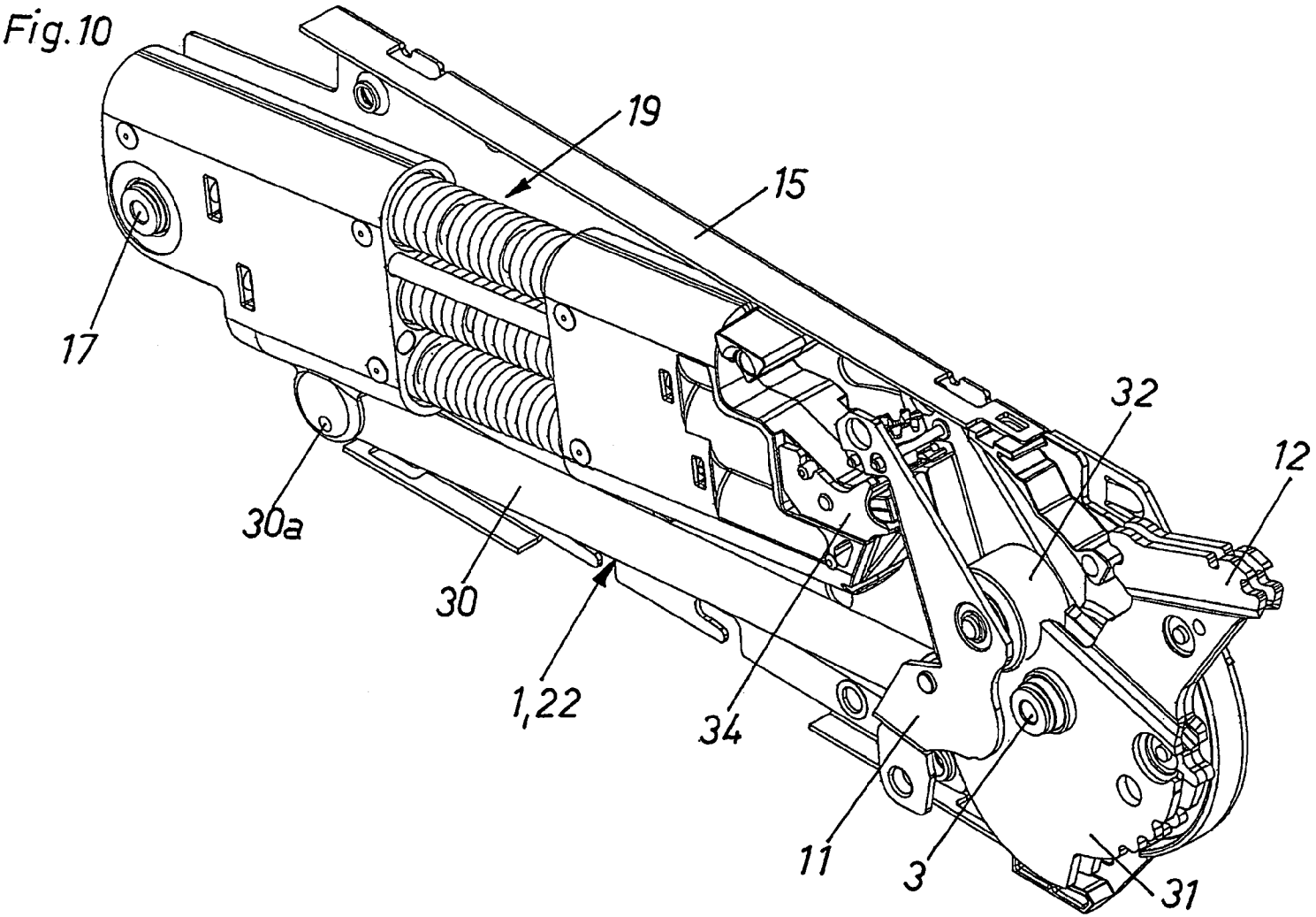
FIG. 10 shows the embodiment according to FIG. 8 and FIG. 9 in a perspective view.

FIG. 10 shows the embodiment of the actuating device according to FIG. 8 and FIG. 9 in a perspective view. Spring device 19 is located and movable on pivotal point 17, and spring loaded setting part 34 is adjustably located on intermediate lever 11 so that the force of thrust roll 32 on control cam 31 can be altered. A swing speed of actuating arm 12 which is higher than a threshold value is decelerated or stopped by fluid damper 30 which forms part of braking device 1. Fluid damper 30 is located on one side of spring device 19, but can also be hingedly arranged on base member 15 in a fixed position. On the other side, the free end of the piston rod can engage with control cam 31, or in compliance with another embodiment of the invention, also with intermediate lever 11 which forms part of transmission mechanism 33. The decisive factor is that fluid damper 30 is arranged so as to affect (directly or indirectly) the swing speed of actuating arm 12.

FIG. 11*a*-11*c* show an embodiment of a fluid damper 30 which can be used advantageously to illustrate this invention.

Fluid damper 30 comprises a cylinder 37 with a least one piston 35 with a piston rod 36 displaceable therein. FIG. 11*a* shows a cross section A-A, FIG. 11*b* shows a side elevation and FIG. 11*c* shows the enlarged representation B from FIG. 11*a*. As can be seen in particular from FIG. 11*c*, piston 35 with its seal 38 is linearly adjustable inside cylinder 37 and piston rod 36 is permanently connected to piston 35. Fluid damper 30 includes a section 39 which is in a fixed position with regard to cylinder 37, which has at least one passage 40 for a fluid, preferably an oil. The other smaller channels 41*a* to 41*d* are provided in addition to passage 40. In addition, a shutter component 42 is arranged which closes passage 40 against the force of spring 43*a* by the pressure of the displaced fluid when a specific threshold value has been exceeded and which is triggered by an abrupt pulling movement in the direction of arrow Z as shown. In FIG. 11*c* as shown, fluid damper 30 is in an open position which essentially permits the free movement of piston rod 36 as well as the free movement of actuating arm 12 which is articulated to piston rod 36. An additional spring 43*b* is provided for the improved switching procedure of fluid damper 30; the force of spring 43*b* is directed against spring 43*a*. This spring 43*b* prevents shutter component 42 from opening suddenly after the closing process. Shutter component 42 is designed as a floating piston in the figure shown. In normal operation, the hydraulic fluid inside cylinder 37 can flow unhindered through the throttle unit fitted. If the penetration speed of the hydraulic oil exceeds a specific value, floating piston 42 is moved to the right and so closes passage 40.

Figures 12A, 12B, 12C:
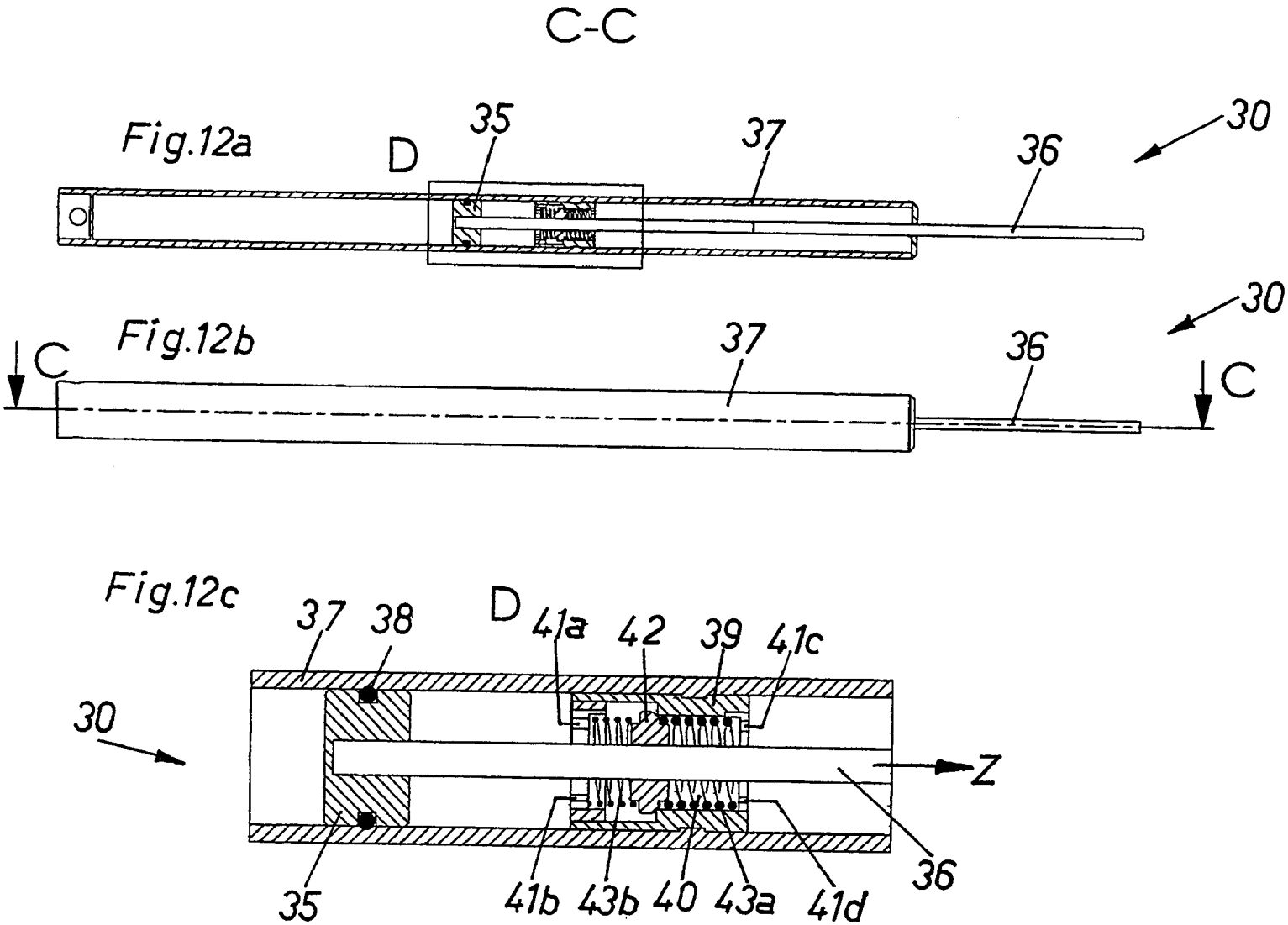
FIGS. 12*a*-12*c* show the embodiment of the fluid damper according to FIG. 11*a* to FIG. 11*c* in which the fluid damper brakes or stops the movement of a actuating arm.

FIGS. 12*a* to 12*c* show the analogous representation of fluid damper 30 in FIGS. 11*a* to 11*c* with the difference that shutter component 42 (floating piston) closes passage 40. In contrast to FIG. 11*c*, shutter component 42 is pressed against corresponding sealing surfaces of passage 40 by the pressure of the displaced fluid in cylinder 37, caused by the sudden pull of the piston rod in direction Z so that the fluid can no longer pass through permanent section 39. The movement of piston rod 36 or of actuating arm 12 is therefore stopped. If, as a result, piston rod 36 is moved below a prescribed speed, switch spring 43*a* will press shutter component 42 back into its starting position against the force of reset spring 43*b*, which is designed to be less resistant, by which process the fluid can again flow through permanent section 39 unhindered.

This invention is not limited to the embodiments shown, but includes or extends to all the variants and technical equivalents which can fall within the scope of the following claims. The positional details which have been selected in the description also refer to the usual installation position of actuating device 9 or to the figure directly described and illustrated and in the event of a change of position may be correspondingly transferred to the new position. It is also within the context of the invention that a mechanical stopping device as well as fluid damper 30 may be preferred as part of braking device 30 or the assembly securing device 22 in compliance with the invention.

The invention claimed is:

1. An actuating device for moving a flap of a piece of furniture, comprising:

a base member;

an actuating arm to be connected to the flap for moving the flap, said actuating arm being mounted to said base member;

a spring device operable to act upon said actuating arm so as to move said actuating arm; and a braking device operable to stop a movement of said actuating arm if a speed of said actuating arm reaches a pre-set speed value, said braking device comprising a centrifugal clutch including:

a first member connected to said actuating arm;

a second member mounted to said base member in a non-rotatable manner, said first member being operable to engage said second member when the speed of said actuating arm reaches the pre-set speed value so as to immediately stop movement of said actuating arm; and a spring member operably connected between said first member and said second member;

wherein said first member has an elongated hole for engaging a bearing axis of said actuating arm so as to allow said first member to radially move relative to said bearing axis, said spring member being shaped and arranged to bias said first member relative to said bearing axis of said actuating member such that, when the speed of said actuating arm reaches the pre-set speed value, a centrifugal force corresponding to said pre-set speed value overcomes a spring force of said spring member to allow said first member to engage said second member.

2. The actuating device of claim 1, wherein said braking device is operable to allow said actuating arm to move freely below the pre-set speed value.

3. The actuating device of claim 1, wherein said braking device is activated when a swing speed of said actuating arm reaches or exceeds the pre-set speed value.

4. The actuating device of claim 1, wherein said first member comprises a first clutch member on a bearing axis of said actuating arm, said first clutch member being shaped and arranged to move radially relative to said bearing axis, said first clutch member forming a part of said centrifugal clutch.

5. The actuating device of claim 4, wherein said first clutch member is spring-loaded.

6. The actuating device of claim 4, wherein said first clutch member has at least one stopping tooth for engaging said second member, said second member comprising a second clutch member.

7. The actuating device of claim 6, wherein said second clutch member comprises an internally geared ring.

8. The actuating device of claim 6, wherein said second clutch member is arranged coaxially with respect to said bearing axis of said actuating arm.

9. The actuating device of claim 6, wherein said spring member of said centrifugal clutch comprises an energy storing device for biasing said first clutch member so as to determine when said first clutch member can engage and disengaged from said second clutch member.

10. The actuating device of claim 9, wherein said energy storing device is shaped and arranged so as to determine the pre-set speed value for activation of said braking device.

11. The actuating device of claim 9, wherein said second clutch member is arranged coaxially with respect to said bearing axis of said actuating arm, said energy storing device being operably arranged between said first clutch member and said second clutch member.

12. The actuating device of claim 11, wherein said second clutch member comprises an internally geared ring and a receiving member integrally connected to said internally geared ring to form a single unitary component.

13. The actuating device of claim 12, wherein said receiving member is rotatably connected to said bearing axis of said actuating arm.

* * * * *